US010500859B2

(12) United States Patent
Chen et al.

(10) Patent No.: US 10,500,859 B2
(45) Date of Patent: Dec. 10, 2019

(54) MOLDED DIE SLIVERS WITH EXPOSED FRONT AND BACK SURFACES

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/110,346

(22) Filed: Aug. 23, 2018

(65) Prior Publication Data

US 2018/0361744 A1 Dec. 20, 2018

Related U.S. Application Data

(63) Continuation of application No. 15/646,163, filed on Jul. 11, 2017, now Pat. No. 10,081,186, which is a (Continued)

(30) Foreign Application Priority Data

Mar. 20, 2013 (WO) ..... PCT/US2013/03304
Jun. 17, 2013 (WO) ..... PCT/US2013/04606
(Continued)

(51) Int. Cl.
*B41J 2/16* (2006.01)
*B41J 2/045* (2006.01)
*B41J 2/14* (2006.01)

(52) U.S. Cl.
CPC ..... *B41J 2/1601* (2013.01); *B41J 2/1607* (2013.01); *B41J 2/1628* (2013.01); *B41J 2/1632* (2013.01);
(Continued)

(58) Field of Classification Search
CPC ..... B41J 2/1601; B41J 2/1607; B41J 2/1628; B41J 2/1632; B41J 2/1637; B41J 2/1645;
(Continued)

(56) References Cited

U.S. PATENT DOCUMENTS 4,881,318 A 11/1989 Komuro
5,016,023 A 5/1991 Chan
(Continued)

FOREIGN PATENT DOCUMENTS

CN 102470672 A 5/2012
CN 103052508 A 4/2013
(Continued)

OTHER PUBLICATIONS

Chen Yue Cheng et al.: A Mortolithic Thermal Inkjet Printhead Combining Anisotropic Etching and Electro Plating; In Input/Output and Imaging Technologies II, 246 Proceedings of SPIE vol. 4080 Jul. 26-27, 2007; pp. 245-252.

*Primary Examiner* — Jason S Uhlenhake
(74) *Attorney, Agent, or Firm* — HP Inc. Patent Department

(57) ABSTRACT

In some examples, a print cartridge comprises a printhead die that includes a die sliver molded into a molding. The die sliver includes a front surface exposed outside the molding to dispense fluid, and a back surface exposed outside the molding and flush with the molding to receive fluid. Edges of the die sliver contact the molding to form a joint between the die sliver and the molding.

18 Claims, 9 Drawing Sheets

Related U.S. Application Data continuation of application No. 14/769,883, filed as application No. PCT/US2014/030945 on Mar. 18, 2014, now Pat. No. 9,724,920.

(30) Foreign Application Priority Data

| | | |
|---|---|---|
| Jun. 27, 2013 | (WO) ..... | PCT/US2013/04821 |
| Jul. 29, 2013 | (WO) ..... | PCT/US2013/05250 |
| Jul. 29, 2013 | (WO) ..... | PCT/US2013/05251 |
| Nov. 5, 2013 | (WO) ..... | PCT/US2013/06852 |

(52) U.S. Cl.
CPC ..... *B41J 2/1637* (2013.01); *B41J 2/1645* (2013.01); *B41J 2/04523* (2013.01); *B41J 2/14145* (2013.01); *B41J 2/1639* (2013.01); *B41J 2202/19* (2013.01); *B41J 2202/20* (2013.01)

(58) Field of Classification Search
CPC ... B41J 2/04523; B41J 2/14145; B41J 2/1639
See application file for complete search history.

(56) References Cited

U.S. PATENT DOCUMENTS

| | | | | |
|---|---|---|---|---|
| 5,565,900 | A | 10/1996 | Cowper | |
| 6,022,482 | A | 2/2000 | Chen et al. | |
| 7,543,924 | B2 | 6/2009 | Silverbrook | |
| 7,862,147 | B2 * | 1/2011 | Ciminelli | B41J 2/14 347/40 |
| 9,724,920 | B2 | 8/2017 | Chen | |
| 2004/0201641 | A1 | 10/2004 | Brugue | |
| 2008/0149024 | A1 | 6/2008 | Petruchik | |
| 2009/0009559 | A1 | 1/2009 | Jindai et al. | |
| 2010/0079542 | A1 | 4/2010 | Ciminelli et al. | |
| 2010/0156989 | A1 * | 6/2010 | Petruchik | B41J 2/14024 347/44 |
| 2011/0037808 | A1 * | 2/2011 | Ciminelli | B41J 2/14072 347/50 |
| 2011/0304673 | A1 | 12/2011 | Ciminelli et al. | |
| 2012/0120158 | A1 | 5/2012 | Sakai et al. | |
| 2012/0212540 | A1 | 8/2012 | Dietl | |
| 2013/0026130 | A1 | 1/2013 | Watanabe | |
| 2016/0016404 | A1 | 1/2016 | Chen | |
| 2017/0008281 | A1 | 1/2017 | Chen | |

FOREIGN PATENT DOCUMENTS

| | | | |
|---|---|---|---|
| EP | 1827844 | | 9/2007 |
| WO | WO-2008151216 | A1 | 12/2008 |
| WO | WO-2012-023941 | A1 | 2/2012 |
| WO | WO-2014/133575 | | 9/2014 |
| WO | WO-2014/133576 | | 9/2014 |
| WO | WO-2014/133577 | | 9/2014 |
| WO | WO-2014-133578 | | 9/2014 |
| WO | WO-2014/133600 | | 9/2014 |
| WO | WO-2014133516 | A1 | 9/2014 |
| WO | WO-2014133561 | | 9/2014 |

* cited by examiner

MOLDED DIE SLIVERS WITH EXPOSED FRONT AND BACK SURFACES

CROSS REFERENCE TO RELATED APPLICATIONS

This is a continuation of U.S. application Ser. No. 15/646,163, filed Jul. 11, 2017, which is a continuation of U.S. application Ser. No. 14/769,883, having a national entry date of Aug. 24, 2015, U.S. Pat. No. 9,724,920, which is a national stage application under 35 U.S.C. § 371 of International Application No. PCT/US2014/030945, filed Mar. 18, 2014, which claims priority to each of International Application Nos. PCT/US2013/033046, filed Mar. 20, 2013, PCT/US2013/046065, filed Jun. 17, 2013, PCT/US2013/048214, filed Jun. 27, 2013, PCT/US2013/052505, filed Jul. 29, 2013, PCT/US2013/052512, filed Jul. 29, 2013, and PCT/US2013/068529, filed Nov. 5, 2013, all of the above hereby incorporated by reference in their entirety.

BACKGROUND

Inkjet pens and print bars can include one or more printhead dies, each having a plurality of fluid ejection elements on a surface of a silicon substrate. Fluid typically flows to the ejection elements through one or more fluid delivery slots formed in the substrate between opposing substrate surfaces. While such slots effectively deliver fluid to the fluid ejection elements, there are some disadvantages associated with their use. From a cost perspective, for example, fluid delivery slots occupy valuable silicon real estate and add significant slot processing cost. Lower printhead die costs can be achieved in part through shrinking the die size. However, a smaller die size results in a tighter slot pitch and/or slot width in the silicon substrate, which adds excessive assembly costs associated with integrating the smaller die into the inkjet pen. In addition, removing material from the substrate to form an ink delivery slot structurally weakens the printhead die. Thus, when a single printhead die has multiple slots (e.g., to improve print quality and speed in a single color printhead die, or to provide different colors in a multicolor printhead die), the printhead die becomes increasingly fragile with the addition of each slot.

BRIEF DESCRIPTION OF THE DRAWINGS

Examples are described below, with reference to the accompanying drawings, in which.

Throughout the drawings, identical reference numbers designate similar, but not necessarily identical, elements.

DETAILED DESCRIPTION

Figure 1:
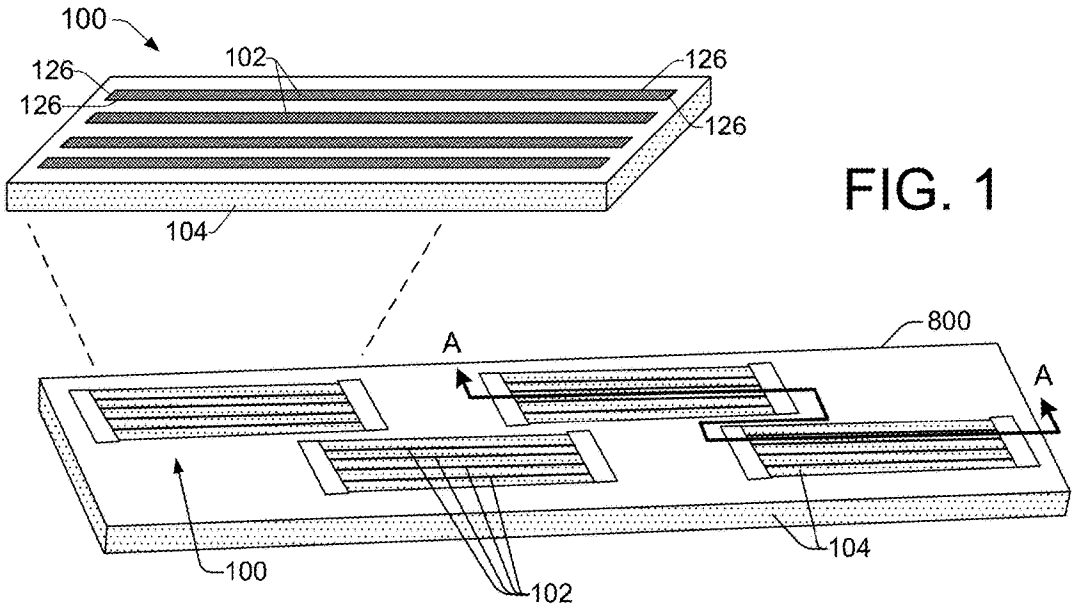
FIG. 1 shows a perspective view of an example of a thinned, molded printhead die that is suitable for use in a fluid ejection device.

Reducing the cost of inkjet printhead dies has been achieved in the past through shrinking the die size and reducing wafer costs. The die size depends significantly on the pitch of fluid delivery slots formed through the silicon substrate that deliver ink from a reservoir on one side of the die to fluid ejection elements on another side of the die. Therefore, prior methods used to shrink the die size have mostly involved reducing the slot pitch and size through a silicon slotting process that can include, for example, laser machining, anisotropic wet etching, dry etching, combinations thereof, and so on. Unfortunately, the silicon slotting process itself adds considerable cost to the printhead die. In addition, as die sizes have decreased, the costs and complexities associated with integrating the smaller dies into an inkjet pen or print bar have begun to exceed the savings gained from the smaller dies. Furthermore, as die sizes have decreased, the removal of die material to form ink delivery slots has had an increasingly adverse impact on die strength, which can increase die failure rates.

Recent developments in molded fluid flow structures, including molded inkjet printheads and molded inkjet print bars, have done away with the use of fluid delivery slots in the die substrate. Examples of the molded fluid flow structures and processes for making such structures are disclosed in international patent application numbers PCT/US2013/046065, filed Jun. 17, 2013, titled Printhead Die, and PCT/US2013/033046, filed Mar. 20, 2013, titled Molding A Fluid Flow Structure, each of which is incorporated herein by reference in its entirety.

These molded fluid flow structures (e.g., molded inkjet printheads) enable the use of tiny printhead die "slivers". A die sliver includes a thin silicon, glass or other substrate (i.e., having a thickness on the order of 650 μm or less) with a ratio of length to width (L/W) of at least three. Molded fluid flow structures, such as a molded inkjet printhead, do not have fluid slots formed through the die sliver substrate. Instead, each die sliver is molded into a monolithic molded body that provides fluidic fan-out through fluid channels formed into the molding at the back surface of the die sliver. Thus, a molded printhead structure avoids significant costs otherwise associated with prior die slotting processes and the related assembly of slotted dies into manifold features of inkjet pens and print bars.

In prior molded inkjet printhead designs, fluid channels formed into the molded body enable printing fluid to flow to the back surface of each die sliver. Fluid/ink feed holes (IFH's) formed through the die sliver from its back surface to its front surface enable the fluid to flow through the sliver to fluid drop ejection chambers on the front surface, where it is ejected from the molded printhead through nozzles. Processes for forming the fluid channels into the molded body, and the ink feed holes into the die sliver, are considerably less costly and complex than the die slotting and assembly processes associated with prior printhead designs. However, these processes do present some added costs and complications. For example, in one fabrication process, a cutting saw is used to plunge cut through the molded body to form the fluid channels in the molded printhead die, as described in international patent application number PCT/US2013/048214, filed Jun. 27, 2013, titled Molded Fluid Flow Structure with Saw Cut Channel, which is incorporated herein by reference in its entirety. In other examples, the fluid channels can be formed in the molded body through compression molding and transfer molding processes such as those described, respectively, in international patent application numbers PCT/US2013/052512, filed Jul. 29, 2013 titled Fluid Structure with Compression Molded Fluid Channel, and PCT/US2013/052505, filed Jul. 29, 2013 titled Transfer Molded Fluid Flow Structure, each of which is incorporated herein by reference in its entirety. Thus, while there are a number of processes available to form the fluid channels in the molded body, each one contributes a measure of cost and complexity to the fabrication of the molded inkjet printheads.

In an effort to further reduce the cost and complexity of molded inkjet printheads, examples described herein include a "thinned", molded printhead die that includes one or more die slivers embedded into a molded body. The molded printhead die is thinned, or ground down, from its back side to remove a portion of the molded body at the back surface of the molded printhead die. Because the molded printhead die is thinned down all the way to the surface of the die sliver (or die slivers) embedded in the molding, there are no fluid channels formed into the molded body to direct fluid to the back surface of the die sliver, as in prior molded inkjet printhead designs. Instead, both the front and back surfaces of each die sliver are flush with the molding material in which the die sliver is embedded. Thinning the molded printhead die in this manner opens up the previously formed fluid/ink feed holes (IFH's) in each die sliver from its back surface to enable fluid to flow from the back surface of the die sliver to fluid ejection chambers on the front surface of the die sliver.

In one example, a printhead includes a die sliver molded into a molding. The die sliver includes a front surface that is flush with the molding and exposed outside the molding to dispense fluid. The die sliver also includes a back surface that is flush with the molding and exposed outside the molding to receive fluid. The die sliver has edges that contact the molding to form a joint between the die sliver and the molding.

In another example, a print bar includes multiple thinned, molded printhead dies embedded in a molding material. The molded printhead dies are arranged generally end to end along the length of a printed circuit board (PCB) in a staggered configuration in which one or more of the dies overlaps an adjacent one or more of the dies. Each molded printhead die comprises a die sliver having a front surface and a back surface exposed outside of the molding. The back surface is to receive fluid and the front surface is to dispense fluid that flows from the back surface to the front surface through fluid feed holes in the die sliver.

In another example, a print cartridge includes a housing to contain a printing fluid and a thinned, molded printhead die. The thinned, molded printhead die comprises a die sliver embedded in a molding. The die sliver has edges forming a joint with the molding, and a front surface and back surface are exposed outside of the molding. The back surface is to receive fluid and the front surface is to dispense fluid that is to flow from the back surface to the front surface through fluid feed holes in the die sliver.

As used in this document, a "printhead" and a "printhead die" mean the part of an inkjet printer or other inkjet type dispenser that can dispense fluid from one or more nozzle openings. A printhead includes one or more printhead dies, and a printhead die includes one or more die slivers. A die "sliver" means a thin substrate (e.g., silicon or glass) having a thickness on the order of 200 μm and a ratio of length to width (L/W) of at least three. A printhead and printhead die are not limited to dispensing ink and other printing fluids, but instead may also dispense other fluids for uses other than printing.

Figure 2:
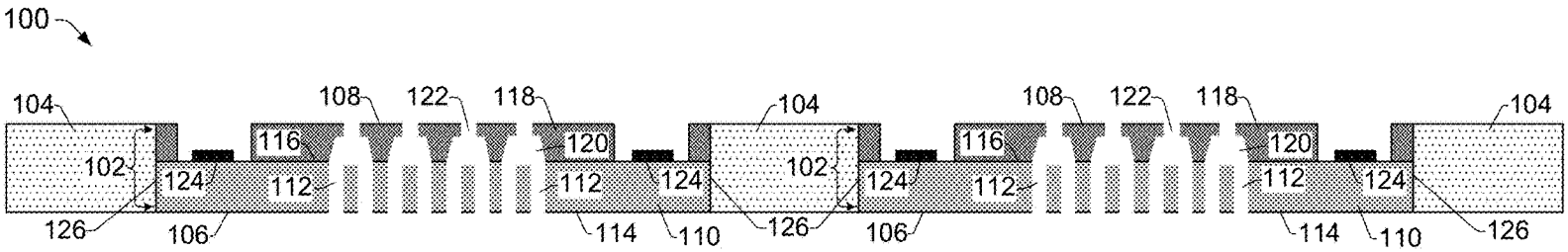
FIG. 2 shows a cross section of the example printhead die taken across line A-A of FIG. 1.

FIG. 1 shows a perspective view of an example of a "thinned", molded printhead die 100 that is suitable for use in fluid ejection devices such as a print cartridge and/or print bar of an inkjet printer. In addition, FIG. 1 shows how one or more printhead dies 100 can be arranged within a printhead assembly 800. The example printhead assembly 800 is discussed in more detail below with respect to FIG. 8. FIG. 2 shows a cross sectional view of the example printhead assembly 800 taken across line A-A of FIG. 1.

Referring generally to FIGS. 1 and 2, the example molded printhead die 100 in FIG. 1 comprises four die slivers 102. The molded printhead die 100 has been "thinned" such that the molding material 104 (referred to interchangeably herein as molding 104, or molded body 104), which comprises an epoxy mold compound, plastic, or other suitable moldable material, has been ground away down to the back surfaces 106 of each of the die slivers 102. Therefore, the back surface 106 of each die sliver 102 is flush with the molding material 104 and is exposed outside (i.e., not covered by) the molding material 104.

Each die sliver 102 has a front surface 108 that opposes its back surface 106. Through a molding process in which the die slivers 102 are molded into the molding material 104, the front surfaces 108 are flush with and remain exposed outside of the molding material 104, enabling each die sliver 102 (and printhead die 100) to dispense fluid. Each die sliver 102 includes a silicon die substrate 110 comprising a thin silicon sliver that includes fluid feed holes 112 dry etched or otherwise formed therein to enable fluid flow through the substrate 110 from a first substrate surface 114 to a second substrate surface 116. In addition to removing the molding material 104 from the back surfaces 106 of die slivers 102, the process used to thin the molded printhead die 100 (e.g., a grinding process) may also remove a thin silicon cap layer (not shown) covering up the fluid feed holes 112 to enable fluid at the back surfaces 106 to enter and flow through the fluid feed holes 112 to the front surfaces 108.

Formed on the second substrate surface 116 are one or more layers 118 that define a fluidic architecture that facilitates the ejection of fluid drops from the molded printhead die 100. The fluidic architecture defined by layer(s) 118 generally includes ejection chambers 120 having corresponding orifices 122, a manifold (not shown), and other fluidic channels and structures. The layer(s) 118 can include, for example, a chamber layer formed on the substrate 110, and a separately formed orifice layer over the chamber layer. In other examples, layer(s) 118 can include a single monolithic layer that combines the chamber and orifice layers. The fluidic architecture layer 118 is typically formed of an SU8 epoxy or some other polyimide material, and can be formed using various processes including a spin coating process and a lamination process.

In addition to a fluidic architecture defined by layer(s) 118 on silicon substrate 110, each die sliver 102 includes integrated circuitry formed on the substrate 110 using thin film layers and elements (not shown). For example, corresponding with each ejection chamber 120 is an ejection element, such as a thermal resistor ejection element or a piezoelectric ejection element, formed on the second surface 116 of substrate 110. The ejection elements are actuated to eject drops or streams of ink or other printing fluid from chambers 120 through orifices 122. Thus, each chamber 120 and corresponding orifice 122 and ejection element generally make up a fluid drop generator formed on the second surface 116 of substrate 110. Ejection elements on each die sliver 102 are connected to bond pads 124 or other suitable electrical terminals on the die sliver 102, directly or through substrate 110. In general, wire bonds connect the die sliver bond pads 124 to a printed circuit board, and the printed circuit board is connected through signal traces in a flex circuit 922 (FIGS. 10, 11) to a controller (FIG. 9, 914; FIG. 12, 1212) on an inkjet printing device (FIG. 9, 900; FIG. 12, 1200), as described in international patent application number PCT/US2013/068529, filed Nov. 5, 2013 titled Molded Printhead, which is incorporated herein by reference in its entirety.

Figure 3:
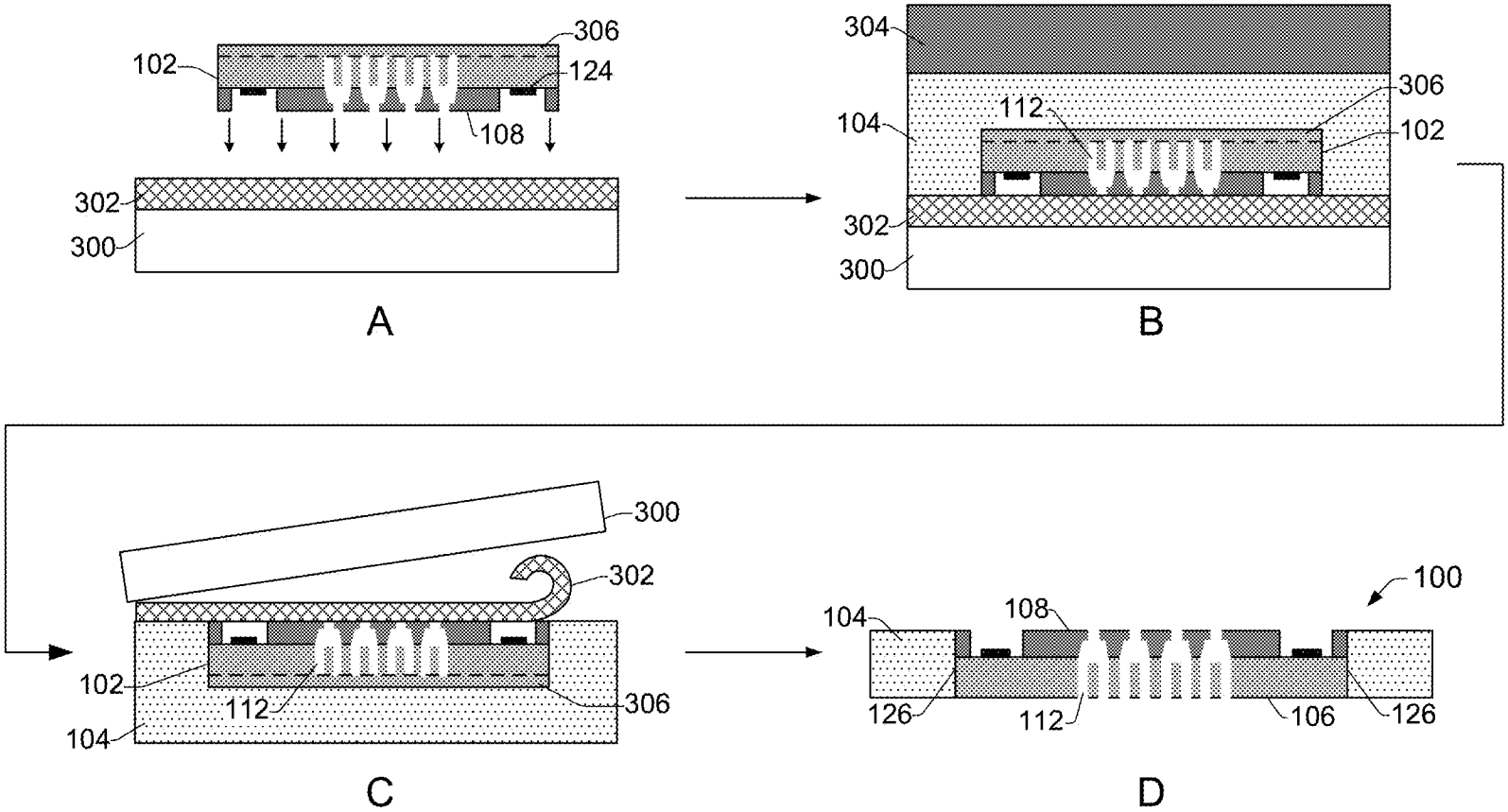
FIG. 3 shows several basic steps of an example process for making and thinning a molded printhead die.

FIG. 3 shows several basic steps in an example process for making and thinning a molded printhead die 100. As shown in FIG. 3 at part "A", a die sliver 102 is attached to a carrier 300 using a thermal release tape 302. The die sliver 102 is placed on the tape 302 with the front surface 108 positioned downward toward the carrier 300 and pressed against the tape 302. The contact between the front surface 108 and the tape 302 seals the area around the bond pads 124 and prevents epoxy mold compound material from entering during a subsequent molding process.

The molding process, generally shown in FIG. 3 at part "B", can be a compression molding process, for example, or another suitable molding process such as a transfer molding process. In a compression molding process, a molding material 104 such as plastic or an epoxy mold compound is preheated and placed with the die sliver 102 in a bottom mold (not specifically shown). A mold top 304 is then brought down, and heat and pressure force the molding material 104 into all the areas within the mold (except in areas around bond pads 124 sealed by tape 302) such that it encapsulates the die sliver 102. During the compression molding process, a thin silicon cap 306 prevents molding material 104 from entering into the fluid feed holes 112 in the sliver substrate 102.

After the compression molding process, the carrier 300 is released from the thermal tape 302, and the tape is removed from the molded printhead die 100, as shown in FIG. 3 at part "C". As shown at part "D" of FIG. 3, the molded printhead die 100 is thinned to remove the molding material covering the back surface 106 of the die sliver 102, and the thin silicon cap 306 covering the fluid feed holes 112. Thinning the die 100 can include grinding down the molding material 104 and the thin silicon cap 306 using a diamond grinding wheel, an ELID (electrolytic in-process dressing) grinding wheel, or another appropriate grinding process. The thinning of the molded printhead die 100 leaves the back surface 106 exposed (i.e., not covered over by molding material 104) and flush with the molding material 104, and it opens up the fluid feed holes 112 so that fluid can flow through the die sliver 102 from the back surface 106 to the front surface 108.

The molding process and the thinning process leave the die slivers 102 embedded within the molding material 104 such that the edges 126 or sides of the die slivers 102 comprise the amount of surface area that forms a joint or connection with the molding 104. In some examples, in order to make the joints between the die sliver 102 and the molding 104 more robust, a joint enhancement feature is incorporated at the edges 126 of the die sliver 102. The joint enhancement feature generally increases the amount of surface area contact between the die sliver 102 and the molding material 104 to improve the connection and reduce the possibility that the die sliver 102 could come loose from the molding material 104.

FIGS. 4-7 show examples of molded printhead dies 100 where the embedded die slivers 102 include examples of joint enhancement features 400. The joint enhancement features 400 shown in FIGS. 4-7 are not intended to be drawn to scale, and they comprise examples of various physical features that can be incorporated at the edges 126 of die slivers 102 to improve the connections between the die slivers 102 and the molding material 104. Thus, the features 400 are provided for the purpose of illustration, and in practice they may be shaped differently and may be smaller or larger than they are shown in FIGS. 4-7.

Figure 4:
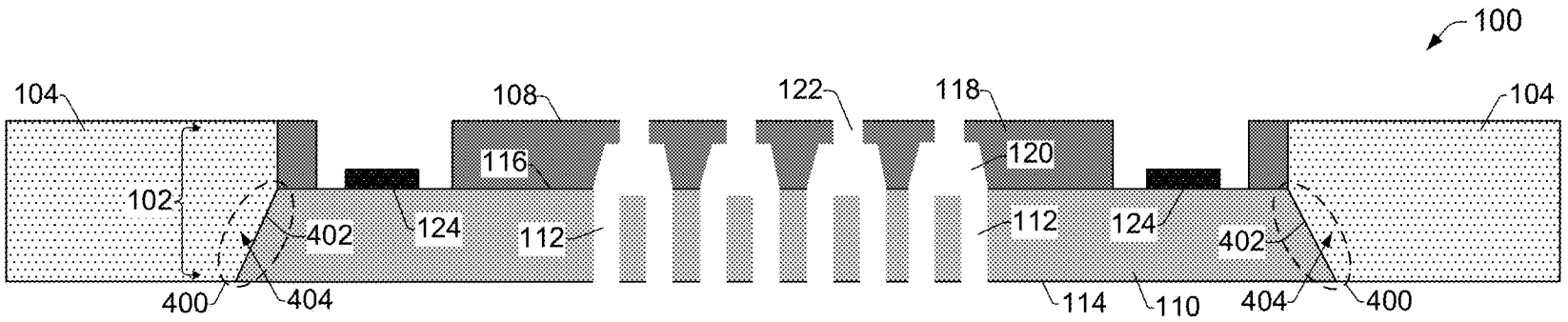
FIGS. 4-7 show examples of molded printhead dies with embedded die slivers that include different examples of joint enhancement features.

As shown in FIG. 4, one example of a joint enhancement feature 400 is provided where edges 126 of the bulk silicon substrate 110 of the die sliver 102 are tapered. In FIG. 4, the tapered edges 402 of substrate 110 taper outward (i.e., away from the die sliver 102) from the second substrate surface 116 to the first substrate surface 114. During the molding process, the molding material 104 forms a molded lip 404 area where the molding material 104 sits over the tapered substrate edges 402. The molded lip 404 and tapered edge 402 help to form a robust joint between the molding material 104 and the die sliver 102. The joint can be formed around all the edges of the die sliver 102 (i.e., four edges 126 of the rectangular die sliver 102), or fewer edges such as two edges.

Figure 5:
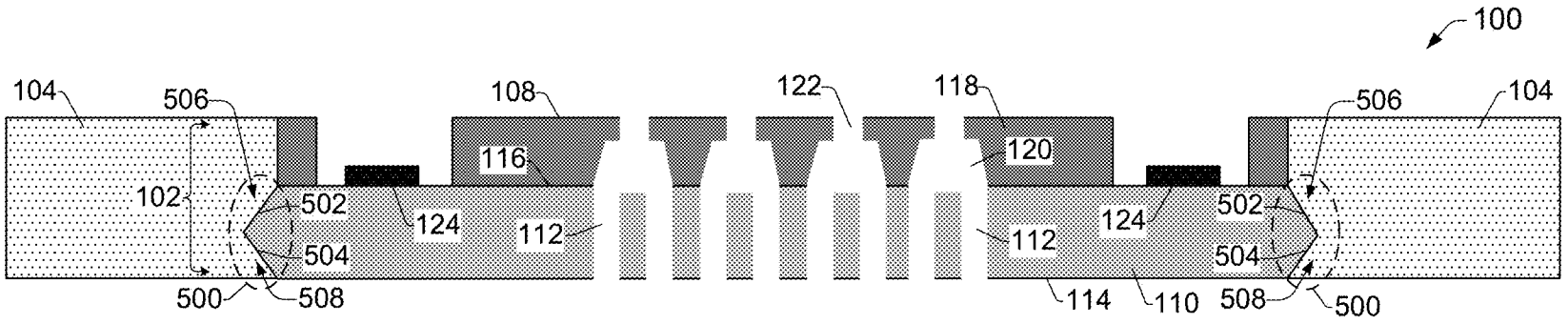

As shown in FIG. 5, another example of a joint enhancement feature 500 is provided where edges 126 of the bulk silicon substrate 110 of the die sliver 102 are tapered in two different directions. In FIG. 5, the edges 126 of substrate 110 include outward tapered edges 502 (i.e., where edges taper away from the die sliver 102) tapering from the second substrate surface 116 to the first substrate surface 114, and inward tapered edges 504 that taper back in toward the die sliver 102 from the first substrate surface 114 to the second substrate surface 116. During the molding process, the molding material 104 forms upper and lower molded lip areas 506, 508, where the molding material 104 wraps around the tapered substrate edges 502, 504. The molded lip areas 506, 508, and tapered edges 502, 504, help to form a robust joint between the molding material 104 and the die sliver 102. The joint can be formed around all the edges of the die sliver 102 (i.e., four edges of the rectangular die sliver 102), or fewer edges such as two edges.

Figure 6:
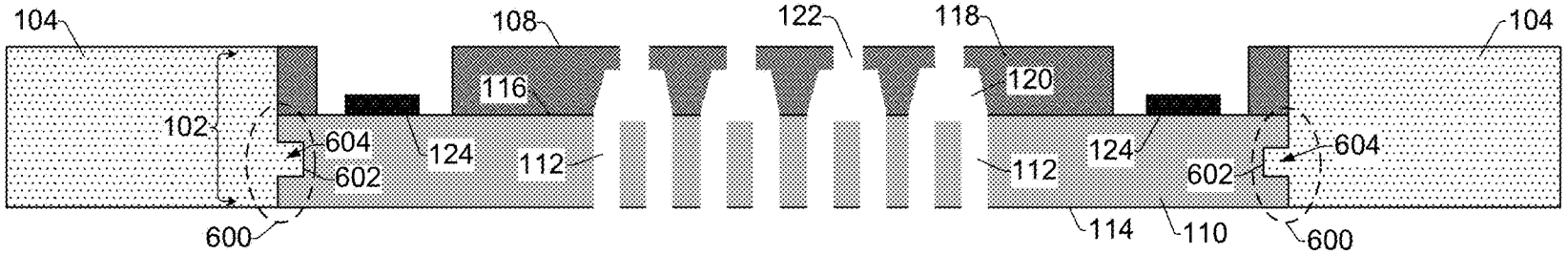

As shown in FIG. 6, another example of a joint enhancement feature 600 is provided where edges 126 of the bulk silicon substrate 110 of the die sliver 102 are notched. In FIG. 6, the notched edges 602 of substrate 110 are notched inward (i.e., toward the die sliver 102), but in other examples they can be notched outward (i.e., away from the die sliver 102). During the molding process, the molding material 104 forms molded notched areas 604 that protrude into, and fill in, the notched edges 602 of the substrate 110. The molded notched areas 604 and notched substrate edges 602 help to form a robust joint between the molding material 104 and the die sliver 102. The joint can be formed around all the edges of the die sliver 102 (i.e., four edges of the rectangular die sliver 102), or fewer edges such as two edges.

Figure 7:
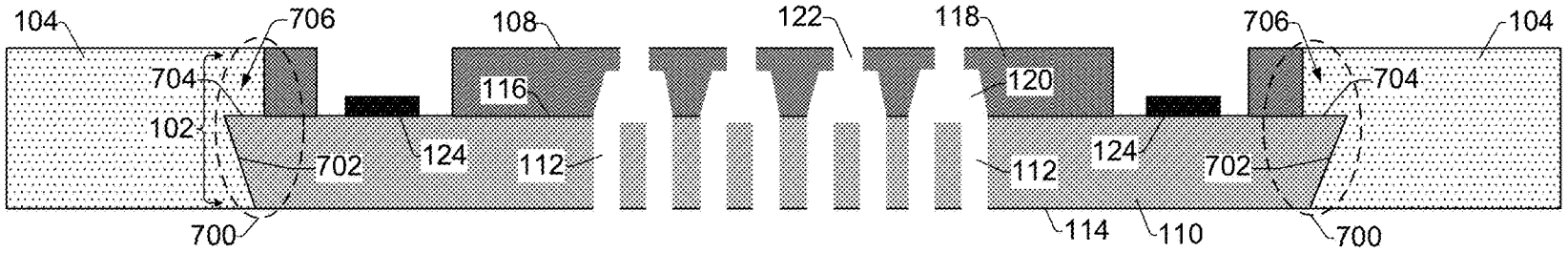

As shown in FIG. 7, another example of a joint enhancement feature 700 is provided where edges 126 of the bulk silicon substrate 110 of the die sliver 102 are tapered. In FIG.

7, the tapered edges 702 of substrate 110 taper outward (i.e., away from the die sliver 102) from the first substrate surface 114 to the second substrate surface 116. This results in the die sliver substrate 110 being slightly wider than the SU8 forming the fluidic architecture layer 118. Therefore, during the molding process, the molding material 104 wraps around the edges 702 and 704 of the substrate 110, forming a molded lip area 706. The molded lip area 706, and substrate 110 edges 702 and 704 help to form a robust joint between the molding material 104 and the die sliver 102. The joint can be formed around all the edges of the die sliver 102 (i.e., four edges of the rectangular die sliver 102), or fewer edges such as two edges.

While specific examples of joint enhancement features are shown and discussed herein with respect to the silicon substrate 110 and fluidics layer 118 at the edges 126 of die sliver 102, the shapes and configurations of such features are not limited in this respect. Rather, joint enhancement features made at the edges 126 of die sliver 102 generally can take on numerous other shapes and configurations including, for example, grooves, cuts, notches, channels, tapers, indentations, bumps, combinations thereof, and so on.

Figure 8:
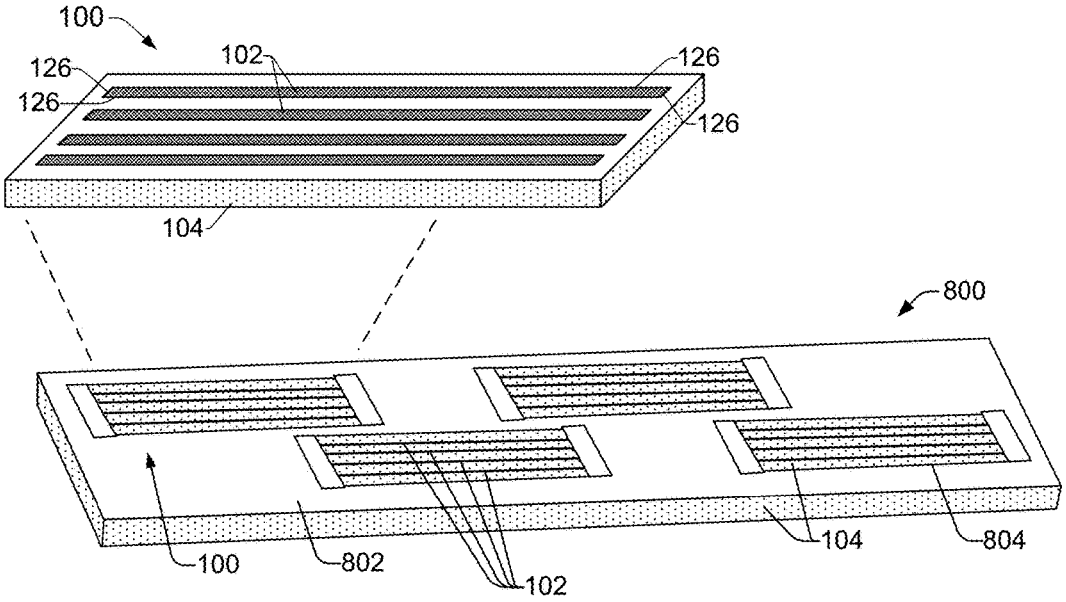
FIG. 8 shows an example printhead assembly with affixed molded printhead dies.

As shown in FIG. 8, one or more molded printhead dies 100 can be adhered to or otherwise affixed to a printhead assembly 800. A printhead assembly 800 typically includes a printed circuit board (PCB) 802, to which the one or more molded printhead dies 100 are attached. Methods of attaching a molded printhead die 100 to a PCB 802 include, for example, using an adhesive or using an additional molding process that molds the PCB 802 and molded printhead die 100 into a monolithic structure. In the example printhead assembly 800 of FIG. 8, each of four molded printhead dies 100 is positioned within a window 804 cut out of the PCB 802. The molded printhead dies 100 and PCB 802 can then be further affixed to a die carrier (FIG. 9; 913) and other structural elements such as a manifold of a print cartridge or print bar for use within an inkjet printing device.

Figure 9:
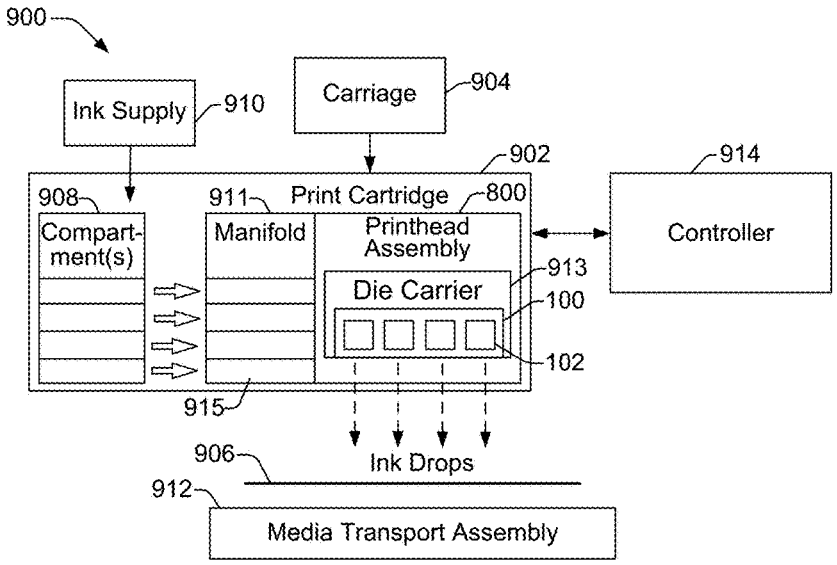
FIG. 9 shows a block diagram of an example inkjet printer with an example print cartridge incorporating an example of a printhead assembly with one or more thinned, molded printhead dies.

As noted above, thinned, molded printhead dies 100 are suitable for use in, for example, a print cartridge and/or print bar of an inkjet printing device. FIG. 9 is a block diagram showing an example of an inkjet printer 900 with a print cartridge 902 that incorporates an example of a printhead assembly 800 comprising one or more thinned, molded printhead dies 100. In printer 900, a carriage 904 scans print cartridge 902 back and forth over a print media 906 to apply ink to media 906 in a desired pattern. Print cartridge 902 includes one or more fluid compartments 908 housed together with printhead 100 that receive ink from an external supply 910 and provide ink to molded printhead die 100. In other examples, the ink supply 910 may be integrated into compartment(s) 908 as part of a self-contained print cartridge 902. Generally, the number of compartments 908 in cartridge 902 corresponds with the number of die slivers 102 embedded in the molded printhead die 100, such that each die sliver 102 can be supplied with a different printing fluid (e.g., a different color ink) from a different compartment 908. A manifold 911 includes ribs or other internal routing structures with corresponding apertures 915 coupled to the back surfaces 106 (e.g., FIG. 1) of the die slivers 102 and/or a die carrier 913 to route printing fluid from each compartment 908 to the appropriate die sliver 102 in the molded printhead die 100. During printing, a media transport assembly 912 moves print media 906 relative to print cartridge 902 to facilitate the application of ink to media 906 in a desired pattern. Controller 914 generally includes the programming, processor(s), memory(ies), electronic circuits and other components needed to control the operative elements of printer 900.

Figure 10:
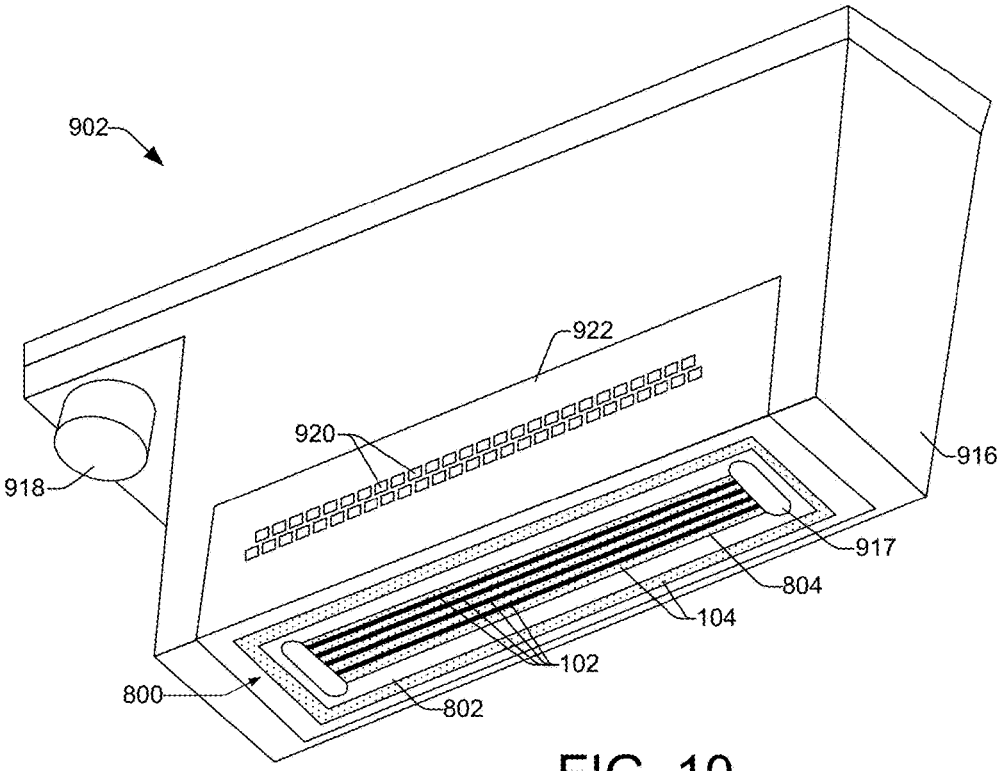
FIG. 10 shows a perspective view of an example print cartridge.

FIG. 10 shows a perspective view of an example print cartridge 902. Referring to FIGS. 9 and 10, print cartridge 902 includes a thinned, molded printhead die 100 supported by a cartridge housing 916. The molded printhead die 100 includes four elongated die slivers 102 and a PCB 802 embedded in a molding material 104 such as an epoxy mold compound. In the example shown, the die slivers 102 are arranged parallel to one another across the width of the molded printhead die 100. The printhead die 100 is located within a window 804 that has been cut out of PCB 802. While a single molded printhead die 100 with four die slivers 102 is shown for print cartridge 902, other configurations are possible, for example with more printhead dies 100 each with more or fewer die slivers 102. At either end of the die slivers 102 are bond wires (not shown) covered by low profile protective coverings 917 comprising a suitable protective material such as an epoxy, and a flat cap placed over the protective material.

Print cartridge 902 is fluidically connected to ink supply 910 through an ink port 918, and is electrically connected to controller 914 through electrical contacts 920. Contacts 920 are formed in a flex circuit 922 affixed to the housing 916. Signal traces (not shown) embedded within flex circuit 922 connect contacts 920 to corresponding contacts (not shown) on printhead die 100. Ink ejection orifices 122 (not shown in FIGS. 9 and 10) on each die sliver 102 are exposed through an opening in the flex circuit 922 along the bottom of cartridge housing 916.

Figure 11:
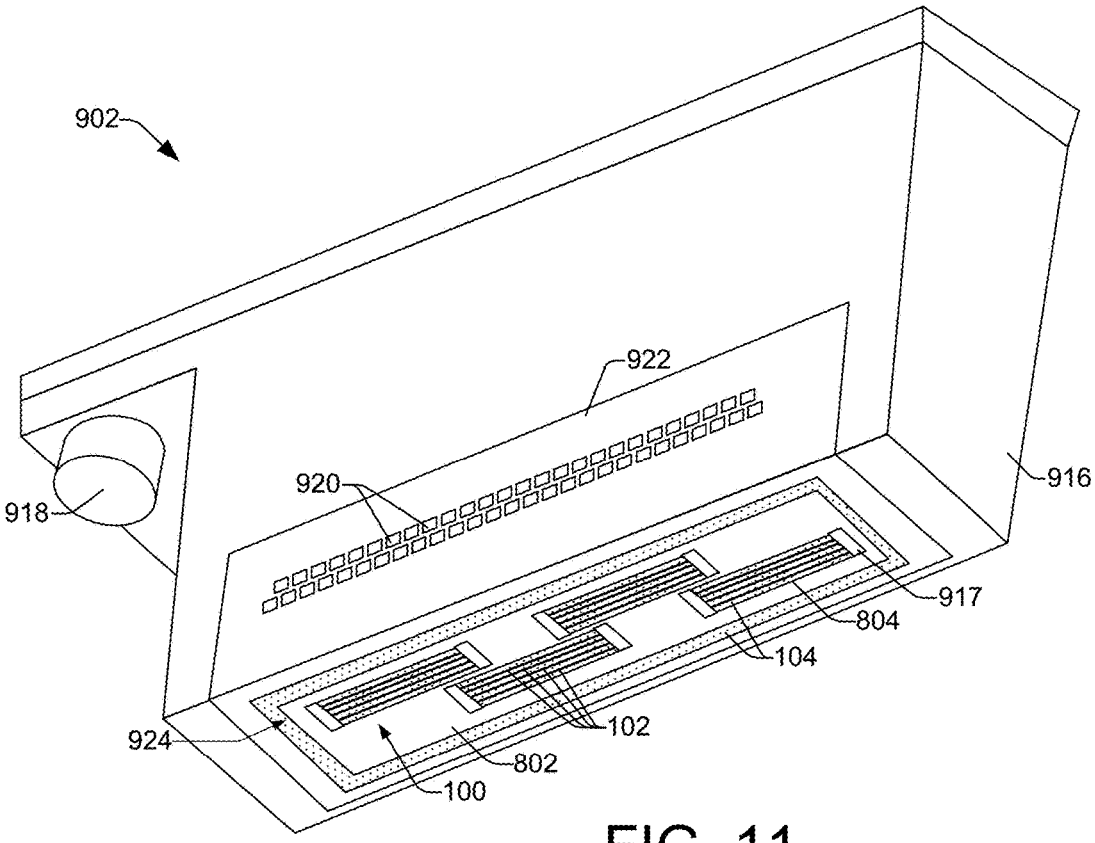
FIG. 11 shows a perspective view of an example print cartridge.
Figure 12:
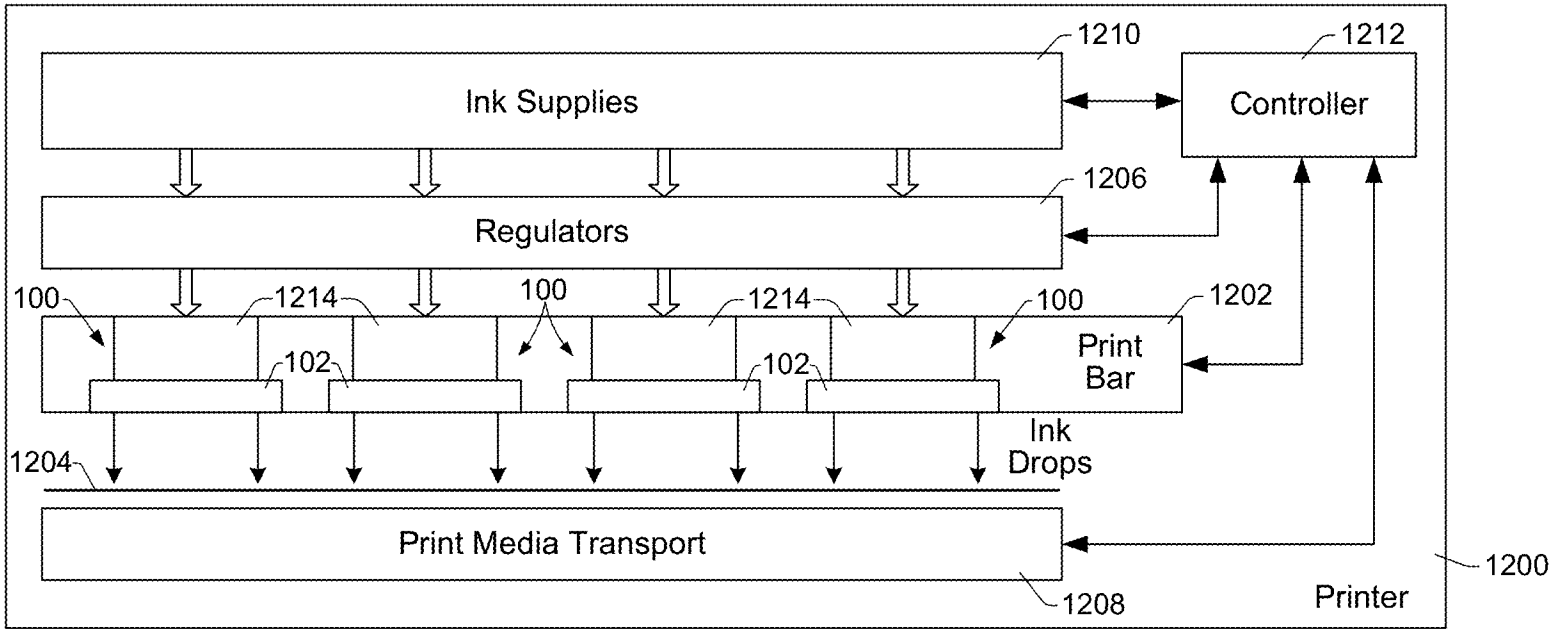
FIG. 12 shows a block diagram of an example inkjet printer with a media wide print bar implementing an example thinned, molded printhead die.

FIG. 11 shows a perspective view of another example print cartridge 902 suitable for use in a printer 900. In this example, the print cartridge 902 includes a printhead assembly 924 with four thinned, molded printhead dies 100 and a PCB 802 embedded in a molding material 104 and supported by cartridge housing 916. Each molded printhead die 100 includes four die slivers 102 and is located within a window 804 cut out of the PCB 802. While a printhead assembly 924 with four thinned, molded printhead dies 100 is shown for this example print cartridge 902, other configurations are possible, for example with more or fewer molded printhead dies 100 that each have more or fewer die slivers 102. At either end of the die slivers 102 in each molded printhead 100 are bond wires (not shown) covered by low profile protective coverings 917 that comprise a suitable protective material such as an epoxy, and a flat cap placed over the protective material. As in the example cartridge 902 shown in FIG. 10, an ink port 918 fluidically connects cartridge 902 with ink supply 910 and electrical contacts 920 electrically connect printhead assembly 924 of cartridge 902 to controller 914 through signal traces embedded in flex circuit 922. Ink ejection orifices 122 (not shown in FIG. 11) on each die sliver 102 are exposed through an opening in flex circuit 922 along the bottom of cartridge housing 916.

FIG. 12 is a block diagram illustrating an inkjet printer 1200 with a media wide print bar 1202 implementing another example of a thinned, molded printhead die 100. Printer 1200 includes print bar 1202 spanning the width of a print media 1204, flow regulators 1206 associated with print bar 1202, a media transport mechanism 1208, ink or other printing fluid supplies 1210, and a printer controller 1212. Controller 1212 represents the programming, processor(s) and associated memories, and the electronic circuitry and components needed to control the operative elements of a printer 1200. Print bar 1202 includes an arrangement of thinned, molded printhead dies 100 for dispensing printing fluid on to a sheet or continuous web of paper or other print media 1204. Die slivers 102 within each molded printhead die 100 receive printing fluid through a flow path from supplies 1210 into and through flow regulators 1206 and a manifold 1214 in print bar 1202.

Figure 13:
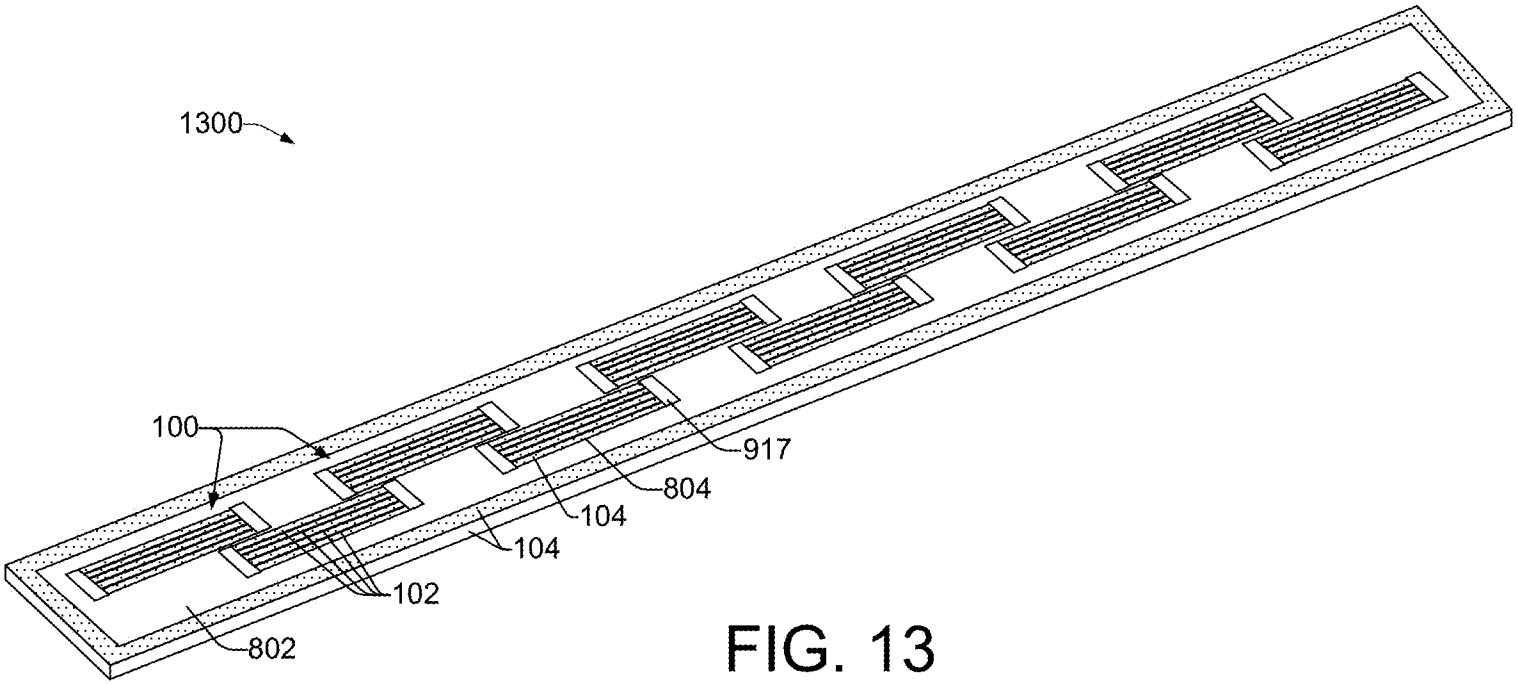
FIG. 13 shows a perspective view of an example molded print bar with multiple thinned, molded printhead dies.

FIG. 13 is a perspective view showing a molded print bar 1300 with multiple thinned, molded printhead dies 100 that is suitable for use in the printer 1200 shown in FIG. 12. The molded print bar 1300 includes multiple thinned, molded printhead dies 100 and a PCB 802 embedded in a molding material 104. The molded printhead dies 100 are arranged within windows 804 cut out of PCB 802 that are in a row lengthwise across the print bar 1300 in a staggered configuration in which each molded printhead die 100 overlaps an adjacent molded printhead die 100. Although ten molded printhead dies 100 are shown in a staggered configuration, more or fewer printhead dies 100 may be used in the same or a different configuration. At either end of the die slivers 102 in each printhead die 100 are bond wires (not shown) that are covered by low profile protective coverings 917 comprising a suitable protective material such as an epoxy, and a flat cap placed over the protective material.

What is claimed is:

1. A print cartridge comprising:

a housing to contain a printing fluid; and a printhead die supported by the housing, the printhead die comprising a molding and a die sliver molded into the molding, the die sliver comprising:

a front surface exposed outside the molding to dispense fluid;

a back surface exposed outside the molding and flush with the molding to receive fluid; and edges that contact the molding to form a joint between the die sliver and the molding.

2. The print cartridge of claim 1, wherein the front surface of the die sliver is flush with the molding.

3. The print cartridge of claim 1, wherein the printhead die comprises:

fluid feed holes formed in the die sliver to enable fluid flow through the die sliver from the back surface to the front surface.

4. The print cartridge of claim 3, wherein the die sliver comprises:

a fluidics layer on the front surface; and drop generators formed in the fluidics layer to receive fluid from the fluid feed holes and to eject fluid drops.

5. The print cartridge of claim 1, wherein the edges comprise tapered edges and the joint comprises a molded lip that covers the tapered edges.

6. The print cartridge of claim 5, wherein the die sliver comprises a silicon substrate and a fluidics layer, and wherein the tapered edges comprise tapered edges of the silicon substrate that taper outward such that the silicon substrate is wider than the fluidics layer.

7. The print cartridge of claim 1, wherein the printhead die comprises:

a joint enhancement feature to increase surface area contact between the edges and the molding.

8. The print cartridge of claim 7, wherein the joint enhancement feature comprises the edges that are tapered in a plurality of directions.

9. The print cartridge of claim 8, wherein the edges comprise outward tapered edges and inward tapered edges.

10. The print cartridge of claim 7, wherein the joint enhancement feature comprises the edges with notches formed in the edges.

11. The print cartridge of claim 7, wherein the joint enhancement feature is selected from the group of features consisting of a groove, a cut, a notch, a channel, an indentation, a bump, and/or a combination thereof.

12. The print cartridge of claim 1, wherein the printhead die comprises:

a plurality of die slivers molded into the molding; and a manifold that includes a plurality of apertures, each aperture of the plurality of apertures associated with a different die sliver of the plurality of die slivers to deliver a particular fluid thereto.

13. The print cartridge of claim 12, further comprising a die carrier to which the plurality of die slivers are adhered.

14. A fluid dispensing device comprising:

a housing to contain a fluid; and a molded printhead die supported by the housing, the molded printhead die comprising:

a molding and a die sliver embedded in the molding, the die sliver having edges forming a joint with the molding, and a front surface and back surface exposed outside of the molding, the back surface flush with the molding to receive fluid, and the front surface to dispense fluid, the fluid to flow from the back surface to the front surface through fluid feed holes in the die sliver.

15. The fluid dispensing device of claim 14, wherein the front surface of the die sliver is flush with the molding.

16. The fluid dispensing device of claim 14, wherein the molded printhead die comprises a plurality of die slivers arranged parallel to one another laterally across the molding along a bottom part of the housing.

17. The fluid dispensing device of claim 14, further comprising:

a die carrier to which the molded printhead die is adhered; and a manifold to route the fluid through the die carrier to the die sliver.

18. The fluid dispensing device of claim 14, wherein the joint comprises:

a tapered edge of the die sliver; and a molded lip of the molding adjacent to the tapered edge of the die sliver.

* * * * *